United States Patent [19]

Vanostrand

[11] 4,021,951

[45] May 10, 1977

[54] FILM STRIP CARRIERS

[76] Inventor: Paul Vanostrand, 4635 Ledge Ave., North Hollywood, Calif. 91602

[22] Filed: Dec. 8, 1975

[21] Appl. No.: 638,980

[52] U.S. Cl. ..... 40/159

[51] Int. Cl.[2] ..... G09F 1/12

[58] Field of Search ..... 40/140, 64 R, 124.2, 40/63 R, 159, 124, 158 B, 159, 128, 145

[56] References Cited

UNITED STATES PATENTS

| | | | |
|---|---|---|---|
| 468,550 | 2/1892 | Rankin | 40/63 |
| 2,643,577 | 6/1953 | Williams | 40/159 X |
| 2,659,992 | 11/1953 | Kiehl et al. | 40/159 |
| 2,785,487 | 3/1957 | Hopp | 40/145 R X |
| 2,861,370 | 11/1958 | McArthur | 40/159 |
| 2,903,808 | 9/1959 | Anderson | 40/64 R X |

FOREIGN PATENTS OR APPLICATIONS

| | | | |
|---|---|---|---|
| 6,402,354 | 9/1965 | Netherlands | 40/64 R |

*Primary Examiner*—Hugh R. Chamblee
*Assistant Examiner*—Wenceslao J. Contreras
*Attorney, Agent, or Firm*—Spensley, Horn & Lubitz

[57] ABSTRACT

An improved film carrier assembly for selectively retaining a film strip therein which is especially suited for use in apartment, hospital and office building directories. The film carrier assembly comprises an elongated panel having a generally rectangular opening disposed therethrough, a groove extending along the length of the top of the panel and a tongue member extending along the bottom of the panel. The groove and the tongue members are arranged and configured on the panel such that additional panels can be selectively coupled thereto in an interlocking and substantially light-tight tongue and groove configuration. A film strip with a name or other information disposed thereon is inserted into the film carrier assembly, and the assembly is placed in a light-containing case. As the light proceeds through the film, the information disposed on the film becomes readily apparent to the viewer. By use of the film carrier assembly of the present invention, the information on the film is clearly indicated and produces a visually pleasing effect. Moreover, the film is securely held in position, but may be easily removed and replaced.

9 Claims, 5 Drawing Figures

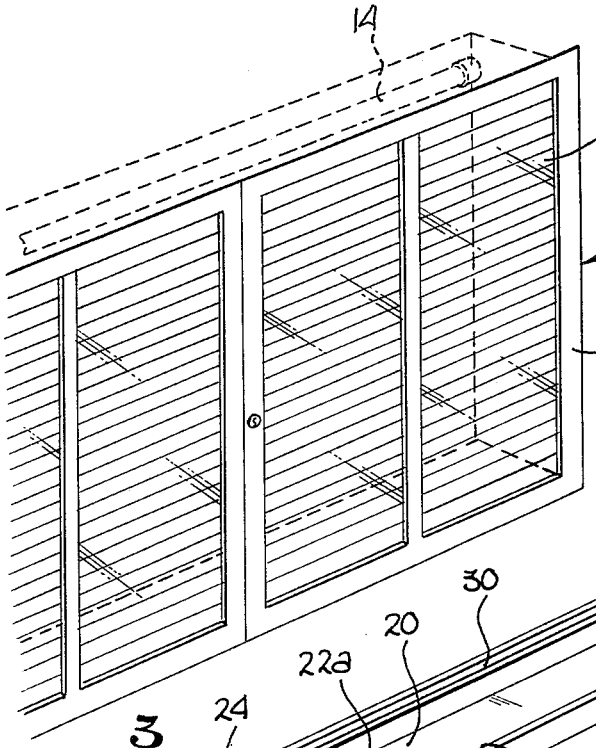
Fig. 1
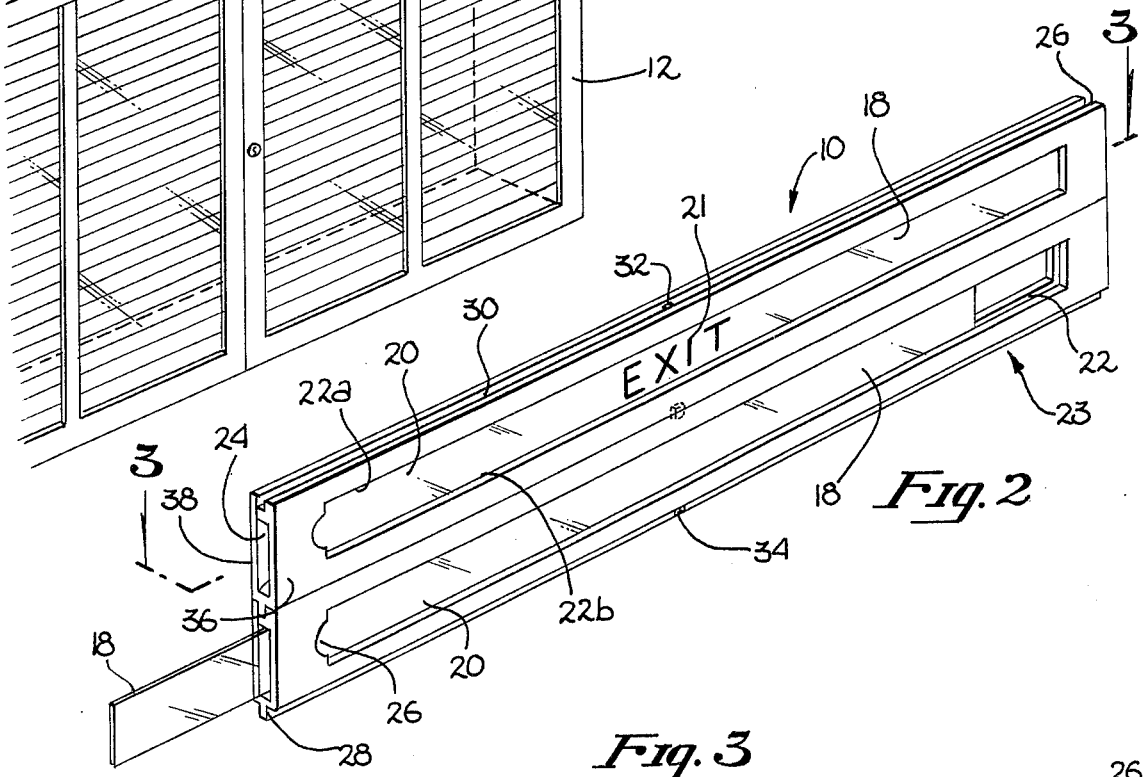
Fig. 2
Fig. 3
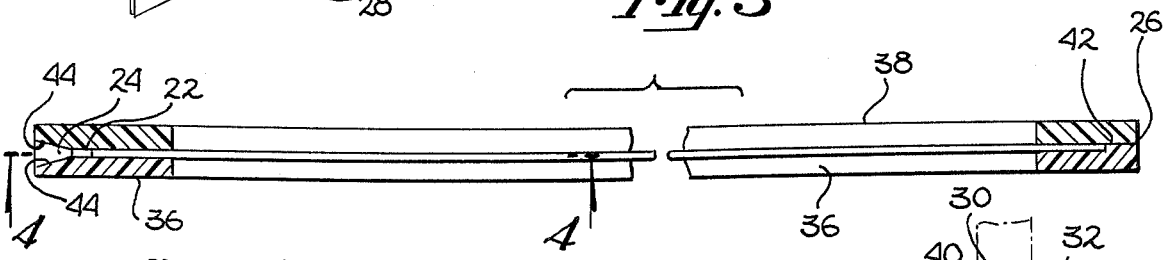
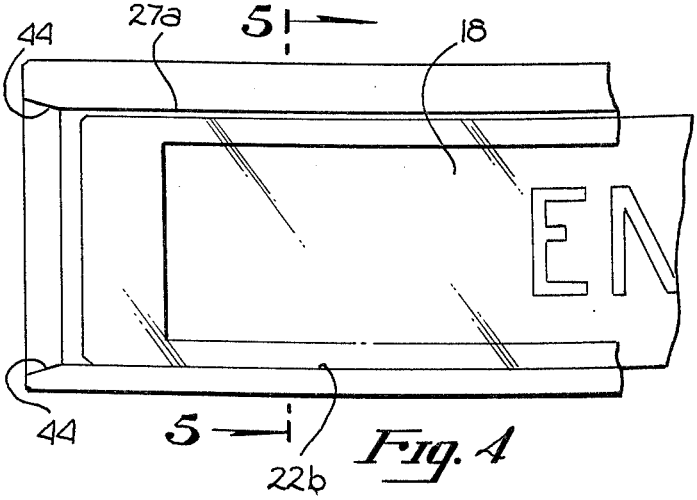
Fig. 4
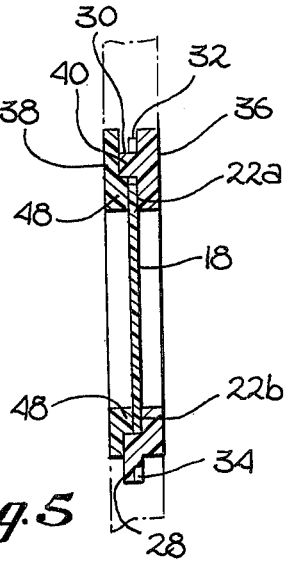
Fig. 5

FILM STRIP CARRIERS

BACKGROUND OF THE INVENTION

1. Field of the Invention

This invention relates to assemblies used in hospitals companies and apartment buildings as part of the directory, and more specifically, to a film strip assembly for selectively retaining a film strip therein used in such directories.

2. Prior Art

In many large apartment buildings, hotels, companies and the like, there is a directory of all the parties and/or locations of various places within the building. For example, upon entry into a building, there is usually a directory indicating all the tenants located in the building, where various stores and shops are, and signs indicating the direction of where the stores and shops are located. Many of these directories are backlighted, i.e., the names appear on the front of the directory and are lit from behind so as to cause the name or other information to be readily visible. One problem associated with this type of prior art directory is the specific type of assembly used to display each of the names, locations and the like in the building. For example, the prior art has used name plates made of strips of cardboard, metal, film and the like with the desired information cut out such that light could pass therethrough. The strip was placed in the directory without any assembly to hold it in position. In such a prior art directory, when a tenant or store moved, or changed its name, it was necessary to remove the strip indicating such name and replace it with a new strip containing the new information. This required that the name plate be entirely removed and replaced with another plate. Such plates are expensive and can be easily scratched or bent when they are being inserted especially if made of a film material.

While the back-lit type directory produces good visual results, the problems associated with strips of film have led to the use of non-backlit type directories where each name is embossed on a metal or cardboard strip and inserted into the directory. This type of directory is not as visually appealing, and again suffers from the problem of requiring new strips when a party's name or other information was being changed. These strips are relatively expensive thus diminishing wide acceptance of such a system.

The present invention is directed toward a uniquely designed film carrier assembly which holds a relatively inexpensive strip of film having the necessary information disposed thereon, which film carrier assembly permits the rapid and easy change of name, and which securely and safely retains the strip of film therein. Thus, the film carrier assembly of the present invention provides a simple, yet effective solution to the aforementioned problems associated with prior art directory and name location indicators.

BRIEF SUMMARY OF THE INVENTION

The present invention relates to a film strip assembly for selectively retaining a film strip therein. The film strip assembly comprises an elongated panel having a central opening permitting light to pass therethrough and further having first and second spaced-apart tracks disposed along the length of the opening so as to extend from the first open end of the panel to a second closed end of the panel. The tracks are arranged and configured to retain the film strip therein such that when the film strip is inserted in the first open end of the panel, it slides along the tracks until it engages the second closed end of the panel. A groove extends along the length of the top of the panel, and a tongue member extends along the length of the bottom of the panel. The tongue and the groove members are arranged and configured such that additional panels may be selectively coupled to the first panel in an interlocking and substantially light-tight tongue and groove configuration. The panel also has an index means disposed on one end of the panel for enabling proper insertion of the film strip.

To use the film strip assembly of the instant invention, a plurality of such assemblies are interconnected one atop the other in a desired configuration. The assemblies each contain interlocking means to prevent undesirable movement. Typically, such a configuration forms the front panel of a back-lit building directory, with each assembly indicating the selected information on the film strip disposed therein. To remove or replace a film strip, the strip is merely slid horizontally outward from the carrier assembly and replaced with a new strip. Although the carrier assemblies are interlocked, they are easily separated, and can therefore be completely removed without disassembly of the entire directory.

The novel features which are believed to be characteristic of the invention, both as to its organization and its method of operation, together with the further objectives and advantages thereof, will be better understood from the following description considered in connection with the accompanying drawings in which a presently preferred embodiment of the invention is illustrated by way of example. It is to be expressly understood, however, that the drawings are for the purpose of illustration and description only and are not intended as a definition of the limits of the invention.

BRIEF DESCRIPTION OF THE DRAWINGS

FIG. 1 is a partial perspective view showing the film carrier assembly disposed in a typical back-lit directory.

FIG. 2 is a perspective view showing the two interlocking film carrier assemblies with associated film strips disposed therein.

FIG. 3 is a cross-sectional view of FIG. 2 taken along line 3—3 showing the first open end and second closed end of the film carrier assembly.

FIG. 4 is an expanded cross-sectional view of FIG. 3 taken along line 4—4 showing the film disposed in the film carrier assembly.

FIG. 5 is a cross-sectional view of FIG. 4 taken along line 5—5 showing how film is disposed in the associated tracks of the film carrier.

DETAILED DESCRIPTION OF THE PREFERRED EMBODIMENT

Broadly, this invention relates to a film carrier assembly for selectively retaining a film strip therein. Referring to FIG. 1, the film carrier assembly 10 is illustrated in a back-lit enclosure 16 such as is typically used as a building directory. In such an enclosure 16, a light, such as florescent light 14, is disposed behind the film carrier assembly 10 whereby the light proceed through the selected areas of the film thereby indicating the desired information, i.e., the film has a dark, substantially light impervious coating, with the coating removed in selected areas so as to form letters, numbers, etc. It has been found that such type of back lighting and film combination produces a very visible and pleasing effect to the viewer. As indicated in this figure, a plurality of film carrier assemblies 10 are mounted one atop the other in an associated mounting door 12. Mounting door 12 is removable from the enclosure 16 such that the assemblies 10 may be interconnected as hereafter discussed.

Referring now to FIG. 2, one can see that the film carrier assembly 10 has an opening 20 of a general rectangular configuration. Disposed in opening 20 is film strip 18 which has various information 21 disposed on it. This information 21 is represented in this figure by the relatively clear area on the film 18 which area selectively permits light to pass therethrough. While the entire film 18 may transmit some light, in the preferred embodiment, film 18 forms a darkened background around information 21 thereby further enhancing the information by causing it to stand out and become that much more visible.

The film carrier assembly 10 is made of a generally elongated rectangular panel 23 having a first open end 24 and a second closed end 26. The panel 23 is comprised of first and second interconnective sections 36 and 38, respectively, which form opening 20 on either side of panel 23. Circumferentially disposed about opening 20 are tracks 22 which are arranged and configured to selectively retain the film 18 therein. Tracks 22 will be hereinafter discussed in more detail. Disposed adjacent the top of the film carrier assembly 10 is a grooved section 30, which extends along the length thereof. Groove section 30 is arranged and configured to accept an associated downwardly extending tongue section 28 disposed adjacent the bottom of a second film carrier assembly. As shown in FIG. 2, two such interconnected film carrier assemblies are shown in a tongue and groove configuration. To prevent movement of such interconnected sections, the tongue section 28 has a slot 34 or other engagement means which engages with a protuberance or other alignment means 32 disposed in the groove 30. The interlocking of the alignment means with the engagement means thereby substantially prevents any lateral sliding action between adjacent interconnected film carrier assemblies.

As is more clearly indicated in FIGS. 3 and 4, the first open end 24 of the assembly 10 is formed of inclined members 44, which form a ramp-like section thereby encouraging the film 18 to proceed into the associated tracks 22. The film 18 proceeds down tracks 22 until it meets the positive stop or closure 42 disposed on end 26 of the film carrier assembly 10. Closure 42 is arranged to prevent movement of film 18 beyond a desired location.

Referring now to FIGS. 4 and 5, a more detailed view of the tracks 22 and how the tracks 22 circumferentially engage in film 18 is indicated. One can see that the tracks 22 engage the entire length of the film 18 adjacent the top and bottom thereof as well as each end of the film. The main section of the tracks 22, which runs along the length of opening 20 adjacent the top and bottom thereof, is formed by two parallel spaced-apart track sections **22*a* and 22*b*. This prevents undesirable escape of the film 18 from the film carrier assembly 10. FIGS. 4 and 5 also indicate how assembly 10 is manufactured. In the presently preferred embodiment, the film carrier assembly 10 is made by interconnecting first section 36 with second section 38, first and second sections 36 and 38 being made of nylon or other plastic and heat-welded or glued together. First section 36 has a ledge member 40 extending outwardly therefrom and adjacent the top thereof. Ledge member 40 is disposed atop an outward-extending platform member 48 on the second section 38. Two platform members 48 extend along the length of the second section 38 adjacent the top and bottom of opening 20. When ledge 40 engages section 38, adjacent the top thereof, groove 30 is formed. Extending downwardly from the bottom of the first section 36 is the tongue member 28. Tongue member 28 is also disposed adjacent to a platform member 48. Note that when the second section 38 is coupled to the first section 36, platform members 48 engage members 28 and 40, respectively, so as to form tracks 22, i.e., platform members 48 are disposed between ledge member 40 and tongue member 28, members 28 and 40 being of a predetermined size such that tracks 22 permit film 18** to slide but yet be retained therein.

In using the device of the instant invention, the film 18 is selectively inserted into the first open end 24 of the assembly 10 and pushed along the length thereof until it abuts against closed end 26. The film is encouraged into end 24 because of the inclined members 44. To indicate which end of the assembly 10 receives the film 18, an index 46 of a general half-moon configuration is cut out of the panel 11. Of course other means for indicating the open end 24 of the assembly are also within the scope of this invention.

After the film 18 is inserted, it will not fall out of end 24, as tracks 22 exert just enough friction on the film 18 to retain the film therein. A plurality of such film-containing assemblies may now be interconnected as desired, and disposed in the back-lit directory case 16. Typically, the film strip carrier mounting panel 12 may be manipulated in place vertically or removed from the case 16 and placed on a flat surface. The assemblies 10 are either inserted in a vertical or horizontal manner depending on the design characteristics of the mounting panel. However, as each assembly is placed one atop the other, the rectangular tongue 28 of one assembly 10 mates with the inward extending groove 30 of the adjacent assembly. The tongue and groove configuration prevents light from passing between adjacent assembly thereby preventing undesirable glare. Moreover, this light-tight arrangement tends to cause the information to stand out and be more visible.

In many applications, 10, 20, or even 30 or more such film assemblies are interconnected and mounted on the panel 12. To prevent any possible sliding action along the length of each of the assemblies, and to increase the stability of the interconnected assembly configuration, each assembly has a slot 34 and a protuberance 32. The protuberance 32 on one assembly 10 is disposed in the slot 34 in an adjacent assembly. Of course, other means for preventing undesirable sliding are within the scope of this invention.

In some embodiments, to remove or replace the film 18, the mounting panel 12 must be tilted such that the desired assembly 10 is exposed. This is due to the fact that many panels retain the assembly 10 by engaging ends 24 and 26. Under such a configuration, one would not be able to slide the film directly out of end 24. However, the assemblies are designed to encourage such tilting action.

While the invention has been described in its preferred embodiment, it is to be understood that the words which have been used are words of description only rather than words of limitation and that changes may be made without departing from the true scope of the invention. For example, opening 20 may be circular or oblong, etc. as well as rectangular; panel 23 may also take on other shapes in addition to being rectangular; the tongue 28 and groove 30 may be of other shapes so long as they interconnect in a light-tight manner; finally, other materials than plastic, such as metal, may be used to make some or all of the assembly 10.

I claim:

1. A film carrier assembly for use with a back-lit directory for selectively retaining a film strip therein comprising:

at least a first elongated panel for slidably retaining said film strip having an opening disposed therethrough to permit light to propagate freely through a substantial portion of said film strip;

a groove extending along the length of the top of said panel, said groove having alignment means disposed thereon; and a tongue member extending along the length of the bottom of said panel, said tongue member having engagement means disposed thereon, said alignment means for interlocking with associated engagement means on a second panel, and said engagement means for interlocking with associated alignment means on a third panel, said engagement and alignment means for preventing translation of said elongated panel in a direction parallel to the elongation of said elongated panel, said groove and said tongue members arranged and configured on said first panel whereby additional panels are selectively coupled to said first panel in an interlocking and substantially light-tight tongue and groove configuration.

2. The film carrier assembly according to claim 1 wherein said panel is comprised of first and second joined sections, said first section having a generally rectangular configuration with said tongue member extending downward therefrom and a generally horizontal ledge member disposed adjacent the top thereof, and said second section having a generally rectangular configuration with outward-extending platform members, said first and second sections joined together whereby (i) said ledge member abuts said second section and forms said groove; and (ii) said platform members are disposed between said ledge member and said tongue member so as to form spaced-apart tracks about said opening.

3. The film carrier assembly according to claim 1 wherein a plurality of said panels are interconnected.

4. The film carrier assembly according to claim 1 wherein said assembly has means for indicating the orientation of said panel.

5. The film carrier assembly according to claim 1 wherein said first and second section are made of plastic.

6. The film carrier assembly according to claim 1 wherein said assembly has a closure at one end thereof to limit the distance said film may travel in said assembly.

7. A film carrier assembly according to claim 1 wherein said panel is comprised of first and second sections joined such that said film is slidably removable from between said sections, said first and second sections defining said opening permitting light to pass therethrough, and forming tracks adjacent to said opening adjacent the top and bottom of said opening, said tracks slidably retaining said film therein.

8. A film carrier assembly according to claim 1 wherein said panel has first and second spaced-apart tracks disposed along the length of said opening so as to extend from a first open end of said panel to a second closed end of said panel, said tracks arranged and configured to slidably retain said film strip such that when said film strip is inserted in said first opening end, it slides along said tracks until said film engaged said second closed end.

9. The film strip assembly according to claim 8 wherein said first open end has ramp-like members which guide said film strip into said tracks.

* * * * *